US008928704B2

(12) United States Patent
Chen

(10) Patent No.: US 8,928,704 B2
(45) Date of Patent: Jan. 6, 2015

(54) ARRAY SUBSTRATE AND LIQUID CRYSTAL DEVICE WITH THE SAME

(71) Applicant: Shenzhen China Star Optoelectronics Technology Co., Ltd., Shenzhen, Guangdong (CN)

(72) Inventor: Cheng-hung Chen, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 240 days.

(21) Appl. No.: 13/699,633

(22) PCT Filed: Oct. 25, 2012

(86) PCT No.: PCT/CN2012/083502

§ 371 (c)(1),
(2) Date: Nov. 22, 2012

(87) PCT Pub. No.: WO2014/059690

PCT Pub. Date: Apr. 24, 2014

(65) Prior Publication Data

US 2014/0111556 A1 Apr. 24, 2014

(30) Foreign Application Priority Data

Oct. 18, 2012 (CN) ..... 2012 1 0398051

(51) Int. Cl.
*G09G 3/20* (2006.01)

(52) U.S. Cl.
CPC ..... *G09G 3/2003* (2013.01); *G09G 3/20* (2013.01)
USPC ..... 345/690; 345/88; 345/92; 345/204; 349/38; 349/48

(58) Field of Classification Search
CPC ..... G09G 3/20; G09G 3/2003
USPC ..... 345/88, 92, 204, 690; 349/38, 48, 128, 349/144
See application file for complete search history.

(56) References Cited

U.S. PATENT DOCUMENTS

| | | | | |
|---|---|---|---|---|
| 7,777,823 | B2 * | 8/2010 | Kim et al. | 349/48 |
| 2008/0266229 | A1 * | 10/2008 | Chang et al. | 345/92 |
| 2010/0110319 | A1 * | 5/2010 | Chen et al. | 349/38 |
| 2010/0253869 | A1 * | 10/2010 | Ting et al. | 349/48 |
| 2011/0115998 | A1 * | 5/2011 | Liao et al. | 349/38 |

* cited by examiner

*Primary Examiner* — Amare Mengistu
*Assistant Examiner* — Jennifer Zubajlo
(74) *Attorney, Agent, or Firm* — Andrew C. Cheng

(57) ABSTRACT

An array substrate is disclosed. Data lines directly pass through the area where a secondary pixel electrode is located to input data signals to the secondary pixel electrode. First scanning lines, second scanning lines and switches are arranged between the adjacent pixels in an up-down direction. The area between the pixels is a dark area corresponding to an opaque area. Under a 3D display mode, a difference of the default voltages exists between a main pixel electrode and a secondary pixel electrode. In addition, a liquid crystal display is provided. By adopting the above design, the crosstalk and the color shift under the 3D display mode may be reduced. In addition, the reliability of the liquid crystal panel may be enhanced.

9 Claims, 8 Drawing Sheets

ARRAY SUBSTRATE AND LIQUID CRYSTAL DEVICE WITH THE SAME

BACKGROUND OF THE INVENTION

1. Field of the Invention

Embodiments of the present disclosure relate to display technology, and more particularly to an array substrate and a liquid display device with the same.

2. Discussion of the Related Art

Film-type patterned retarder (FPR) is an imaging method of current 3D liquid crystal display. As shown in FIG. 1, the FPR display system includes a down substrate 11, an up substrate 12, and a patterned retarder film 13. The down substrate 11 and the up substrate 12 form a liquid crystal panel including an imaging unit 14 for displaying images. The imaging unit 14 includes a left image unit 141 corresponding to a pixel for displaying a left eye image and a right image unit 142 corresponding to a pixel for displaying a right eye image. The patterned retarder film 13 is adhesively attached to the liquid, crystal panel. The patterned retarder film 13 cooperates with a polarized glass 16 to split the 3D image to the left eye image 21 and the right eye image 22, and then transmits the images to viewers. However, under a 3D display mode crosstalk may exist when the viewer is at a wide viewing angle. For example, the left eye image 21 is also observed by the right eye. Usually, the solution is to increase the width of the black matrix 15 between the left image unit 141 and the right image unit 142. In addition, the width of the black matrix 15 has to be increased to some degree so that the crosstalk may be reduced.

For a multi-domain vertical alignment (MVA) display, a larger color shift exists when the viewing angle is large. Generally, a charge-shared technology is adopted to obtain a low color shift. As shown in FIG. 2, a pixel (N) is divided into a main pixel (N) and a secondary pixel (N). One pixel (N) 30 corresponds to two scanning lines (N), (M) turn on at different time. Thin-film transistors 31, 32 are turn on when the scanning lines are at high level. A data line (x) transmits voltage signals to the main pixel (N) and the secondary pixel (N) via the thin-film transistors 31, 32 at the same time such that the level of the main pixel (N) and the secondary pixel (N) are the same. After the scanning line (N) is closed, the high level is input to the scanning line (M) to turn on the thin-film transistors 33. An input of the thin-film transistor 33 connects to the pixel electrode of the secondary pixel (N). An output of the thin-film transistors 33 connects to one end of the storage capacitor 34. The other end of the storage capacitor 34 connects to the common electrode on another substrate. When the liquid crystal panel is driven, the polarity switches between a positive voltage and a negative voltage. Before the thin-film transistors 33 is turn on, the polarity of the charges is opposite to that of the charges of the current secondary pixel (N). Thus, after the thin-film transistors 33 is turn on, the charges of the secondary pixel (N) are neutralized by the storage capacitor 34 to decrease the electrical field of the secondary pixel (N). As such, there is a difference between the electrical fields of the main pixel (N) and the secondary pixel (N) and the color shift is reduced at wide viewing angle.

However, by adopting the above charge-shared technology, the two scanning lines (N), (M) of the pixel (N) 30 are arranged between the main pixel (N) and the secondary pixel (N). The Thin-film transistors 31, 32 connected with the scanning line (N) and the transistors 33 and the storage capacitor 34 connected with the scanning line (M) are arranged between the main pixel (N) and the secondary pixel (N). As shown in FIG. 3, the main dark area 35 corresponding to an opaque area is arranged between the main pixel (N) and the secondary pixel (N) of the pixel (N) 30. The width of the main dark area 35 is larger than that of the dark area 36 between the pixel (N) 30 and the pixel (N+1) 40. When the FRP 3D display technology is applied to the MVA panel, the width of the corresponding black matrix 15 between the left image unit 141 and the right image unit 142 is smaller, which does not helpful to reduce the crosstalk. Thus, the charge-shared technology is not suitable for the FPR 3D display mode.

In another design as shown in FIG. 4, one pixel (N) 50 includes the main pixel (N) and the secondary pixel (N). Two corresponding scanning lines are arranged in the same side of the pixel (N) 50. Wherein the scanning line (N) connects to the pixel electrodes of the main pixel (N) and the secondary pixel (N) via the thin film transistors 51, 52. The scanning line (M) connects to the pixel electrode of the secondary pixel (N) via the thin film transistor 51, 53. The output of the thin film transistor 53 connects to the storage capacitor 54. The corresponding scanning lines and thin film transistors of the pixel (N) 50 are arranged on the same side of the pixel (N) 50. As shown in FIG. 5, the distance between the pixel (N) 50 and the pixel (N1) 60 is large. That is, the width of the main dark area 57 is large. When the FPR 3D display technology is applied to the MVA panel, width of the black matrix 15 between the left image unit 141 and the right image unit 142 is large so that the crosstalk is reduced. As such, this charge-shared technology is more suitable for the FRP 3D display mode than that shown in FIG. 2.

However, with respect to the charge-shared technology shown in FIG. 4, a connection 55 connecting, to the pixel electrode of the secondary pixel (N) has to pass through the area where the main pixel (N) is located. In this way, a larger parasitic capacitance 56 is larger between the pixel electrodes of the main pixel (N) and the secondary pixel (N). The parasitic capacitance 56 may reduce the level of the main pixel (N) and the secondary pixel (N). In addition, in the process of 4PEP, the parasitic capacitance 56 changes due to the being radiated by lights. As such, the reliability of the liquid crystal display is reduced. In addition, as the connection 55 passes through the area where the main pixel (N) is located, the transmission rate and the aperture rate are reduced.

SUMMARY

The object of the claimed invention is to provide an array substrate and a liquid crystal device capable of reducing crosstalk under a 3D display mode. The array substrate and the liquid crystal device may also reduce the color shift and enhance the transmission rate and the aperture rate at large viewing angle.

In one aspect, an array substrate of a multi-domain vertical alignment (MVA) liquid crystal display includes: a plurality of first scanning lines, a plurality of second scanning lines, a plurality of data lines, and a plurality of pixels arranged in matrix, each pixel includes switches and pixel electrodes, and each pixels corresponds to one first scanning line, one second scanning line, and one data line; the switches of each pixel includes at least a first switch, a second switch and a third switch, and each of the switches includes a control end, an input end and an output end; the pixel electrodes includes a main pixel electrode and a secondary pixel electrode, the first scanning line and the second scanning line respectively connect with the first switch and the second switch so as to turn on or oil the first switch and the second switch the data lines pass through the respective areas where the main pixel electrode is located and where the secondary pixel electrode is located to connect to the main pixel electrode and the secondary pixel electrode such that voltage signals are input to the main pixel electrode and the secondary pixel electrode; a dark area corresponding to an opaque area, at least portions of the dark area is arranged between the pixels, and the first scanning lines, the second scanning lines and the switches are arranged between the pixels; wherein for any three adjacent pixels arranged along the data lines, the first scanning line and the first switch corresponding to the second pixel are adjacent to the second scanning line, the second switch and the third switch corresponding to the first pixel so as to input scanning signals to the main pixel electrode, the second scanning line, the second switch, and the third switch corresponding to the second pixel are adjacent to the first scanning line and the first switch corresponding to the third pixel so as to input the scanning signals to the secondary pixel electrode; the output of the first switch electrically connects to the main pixel electrode, the output of the second switch electrically connects with the secondary pixel, the output of the third switch is for electrically connecting a storage capacitor, the inputs of the first switch and the second switch electrically connect to the data lines respectively, the input of the third switch electrically connects with the secondary pixel electrode, the control end of the first switch electrically connects the first scanning line, the control end of the second switch electrically connects the second scanning line, the control end of the third, control switch electrically connects the second scanning line of the third pixel;

Wherein the first scanning lines and the second scanning lines corresponding to the second pixel input the scanning signals in the 3D display mode to respectively turn on the first switch and the second switch, the data lines inputs the voltage signals to the main pixel electrode and the secondary pixel electrode of the second pixel respectively by the first switch and the second switch at the same time, and then the scanning signals are not input to, the first scanning lines and the second scanning lines, the first scanning lines corresponding to the third pixel electrically connected to the control end of the third switch input the scanning signals to turn on the third switch, the voltage signals of the secondary pixel electrode of the second pixel couple with the storage capacitor electrically connected with the output of the third switch via the third switch to adjust the storage capacitor such that a difference between the default voltages of the main pixel electrode and the secondary pixel electrode of the second pixel is controlled.

Wherein the first scanning lines and the first switch of the pixel are arranged on the same side with the pixel, and the second scanning line, the second switch and the third switch are arranged on the other side of the pixel.

Wherein the storage capacitor is formed by a metal layer on the same side of the array substrate and a common electrode of the liquid crystal panel, and the polarity of the charges stored in the storage capacitor is opposite to that of the secondary pixel electrode.

Wherein the first switch, the second switch, and the third switch are respectively a first thin-film transistor, a second thin-film transistor, and a third thin-film transistor; the first thin film transistor includes a first gate, a first source and a first drain, the first source operates as an input electrically connected with the data lines, the first drain operates as an output electrically connected with the main pixel electrode, and the first gate operates as a control end electrically connected with the first scanning, line to turn on or off the first thin film transistor; the second thin film transistor includes a second gate, a second source and a second drain, the second source operates as the input electrically connected with the data lines, the second drain operates as the output electrically connected with the secondary pixel electrode, and the second gate operates as the control end electrically connected with the second scanning line to turn on or off the second thin film transistor; and the third thin film transistor includes a third gate, a third source and a third drain, the third source electrically connects with the secondary pixel electrode, the third drain operates as the output for electrically connecting with the storage capacitor, and the third gate electrically connects with the first scanning lines corresponding to one adjacent pixel to turn on or off the third thin film transistor.

In another aspect, a liquid crystal display includes: a polarizing film and a liquid crystal panel comprising an array substrate and a color filter substrate; the color filter substrate includes a black matrix, and the polarizing film is arranged on an outside of the color filter substrate. The array substrate includes: a plurality of first scanning lines, a plurality of second scanning lines, a plurality of data lines, and a plurality of pixels arranged in matrix, each pixel includes switches and pixel electrodes, and each pixels corresponds to one first scanning line, one second scanning line, and one data line; the switches of each pixel includes at least a first switch, a second switch and a third switch, and each of the switches includes a control end, an input end and an output end; the pixel electrodes includes a main pixel electrode and a secondary pixel electrode, the first scanning line and the second scanning line respectively connect with the first switch and the second switch so as to turn on or off the first switch and the second switch, the data lines pass through the respective areas where the main pixel electrode is located and where the secondary pixel electrode is located to connect to the main pixel electrode and the secondary pixel electrode such that voltage signals are input to the main pixel electrode and the secondary pixel electrode; a dark area corresponding to an opaque area, the dark area is in a vertically projected area of the black matrix, at least portions of the dark area is arranged between the pixels, and the first scanning lines, the second scanning lines and the switches are arranged between the pixels; wherein for any three adjacent pixels arranged along the data lines, the first scanning line and the first switch corresponding to the second pixel are adjacent to the second scanning line, the second switch and the third switch corresponding to the first pixel so as to input scanning signals to the main pixel electrode, the second scanning line, the second switch, and the third switch corresponding to the second pixel are adjacent to the first scanning line and the first switch corresponding to the third pixel so as to input the scanning signals to the secondary pixel electrode; the output of the first switch electrically connects to the main pixel electrode, the output of the second switch electrically connects with the secondary pixel, the output of the third switch is for electrically connecting a storage capacitor, the inputs of the first switch and the second switch electrically connect to the data lines respectively, the input of the third switch electrically connects with the secondary pixel electrode, the control end of the first switch electrically connects the first scanning line, the control end of the second switch electrically connects the second scanning line, the control end of the third control switch electrically connects the second scanning line of the third pixel; wherein the first scanning lines and the second scanning lines corresponding to the second pixel input the scanning signals in the 3D display mode to respectively turn on the first switch and the second switch, the data lines inputs the voltage signals to the main pixel electrode and the secondary pixel electrode of the second pixel respectively by the first switch and the second switch at the same time, and then the scanning signals are not input to the first scanning lines and the second scanning lines, the first scanning lines corresponding to the third pixel electrically connected to the control end of the third switch input the scanning signals to turn on the third switch the voltage signals of the secondary pixel electrode of the second pixel couple with the storage capacitor electrically connected with the output of the third switch via the third switch to adjust the storage capacitor such that a difference between the default voltages of the main pixel electrode and the secondary pixel electrode of the second pixel is controlled.

Wherein the first scanning lines and the first switch of the pixel are arranged on the same side with the pixel, and the second scanning line, the second switch and the third switch are arranged on the other side of the pixel.

Wherein the storage capacitor is formed by a metal layer on the same side of the array substrate and a common electrode of the liquid crystal panel, and the polarity of the charges stored in the storage capacitor is opposite to that of the secondary pixel electrode.

Wherein the first switch, the second switch, and the third switch are respectively a first thin-film transistor, a second thin-film transistor, and a third thin-film transistor; the first thin film transistor includes a first gate, a first source and a first drain, the first source operates as an input electrically connected with the data lines, the first drain operates as an output electrically connected with, the main pixel electrode, and the first gate operates as a control end electrically connected with the first scanning line to turn on or off the first thin film transistor; the second thin film transistor includes a second gate, a second source and a second drain, the second source operates as the input electrically connected with the data lines, the second drain operates as the output electrically connected with the secondary pixel electrode, and the second gate operates as the control end electrically connected with the second scanning line to turn on or of the second thin film transistor; and the third thin film transistor includes a third gate, a third source and a third drain, the third source electrically connects with the secondary pixel electrode, the third drain operates as the output for electrically connecting with the storage capacitor, and the third gate electrically connects with the first scanning lines corresponding to one adjacent pixel to turn on or off the third thin film transistor.

Wherein the liquid crystal panel is a MVA display.

DETAILED DESCRIPTION OF THE EMBODIMENTS

Embodiments of the invention will now be described more hilly hereinafter with reference to the accompanying drawings, in which embodiments of the invention are shown.

Figure 1:
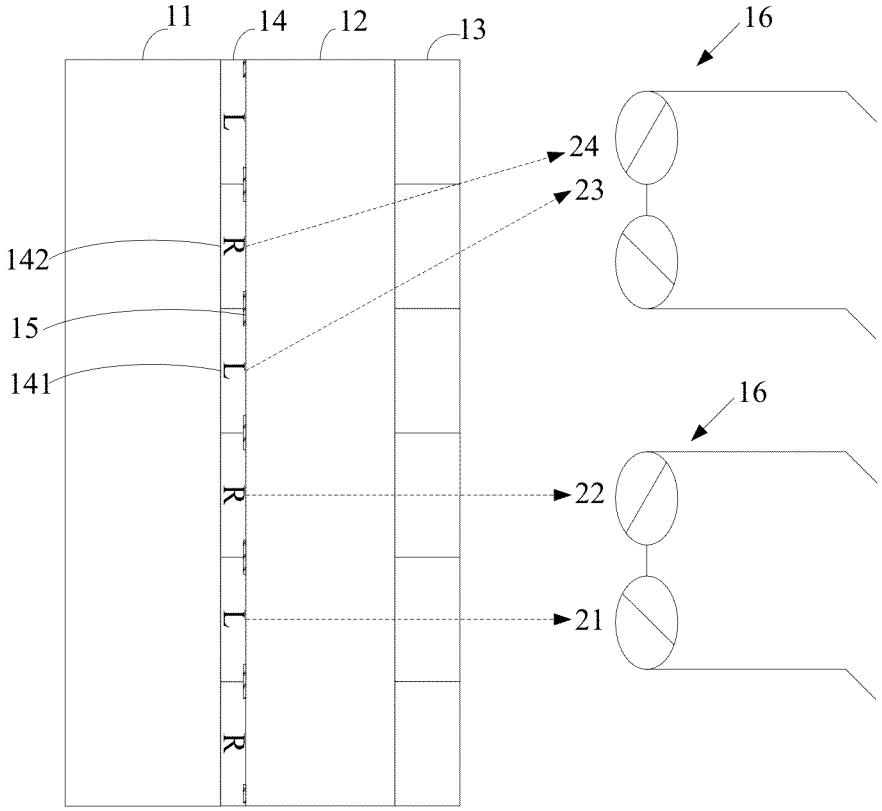
FIG. 1 is a schematic view of a typical FPR 3D display system, wherein the lighting paths of two viewing angles are shown.
Figure 2:
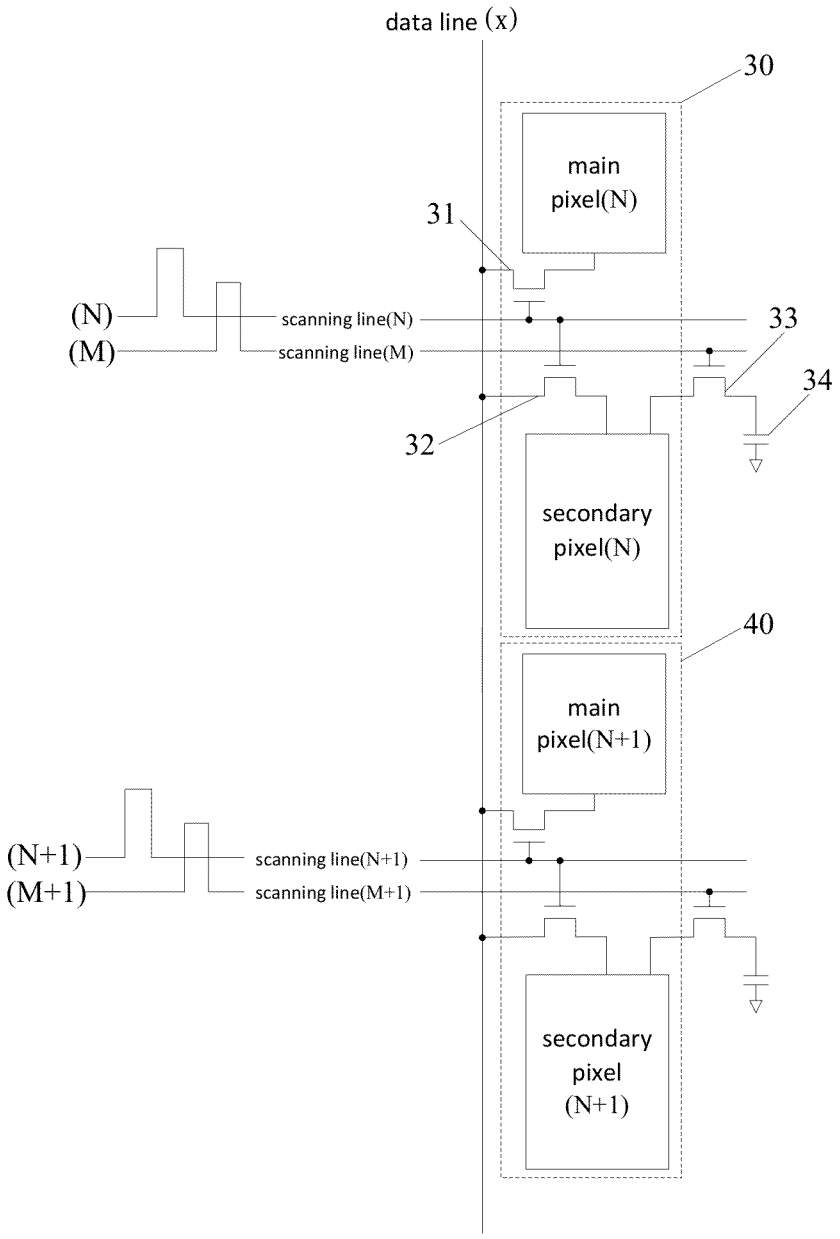
FIG. 2 is a schematic view of the pixels of a typical MVA liquid crystal display.
Figure 3:
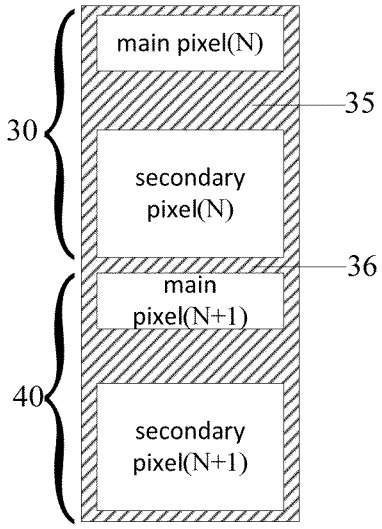
FIG. 3 is a planer view of the pixels of FIG. 2.
Figure 4:
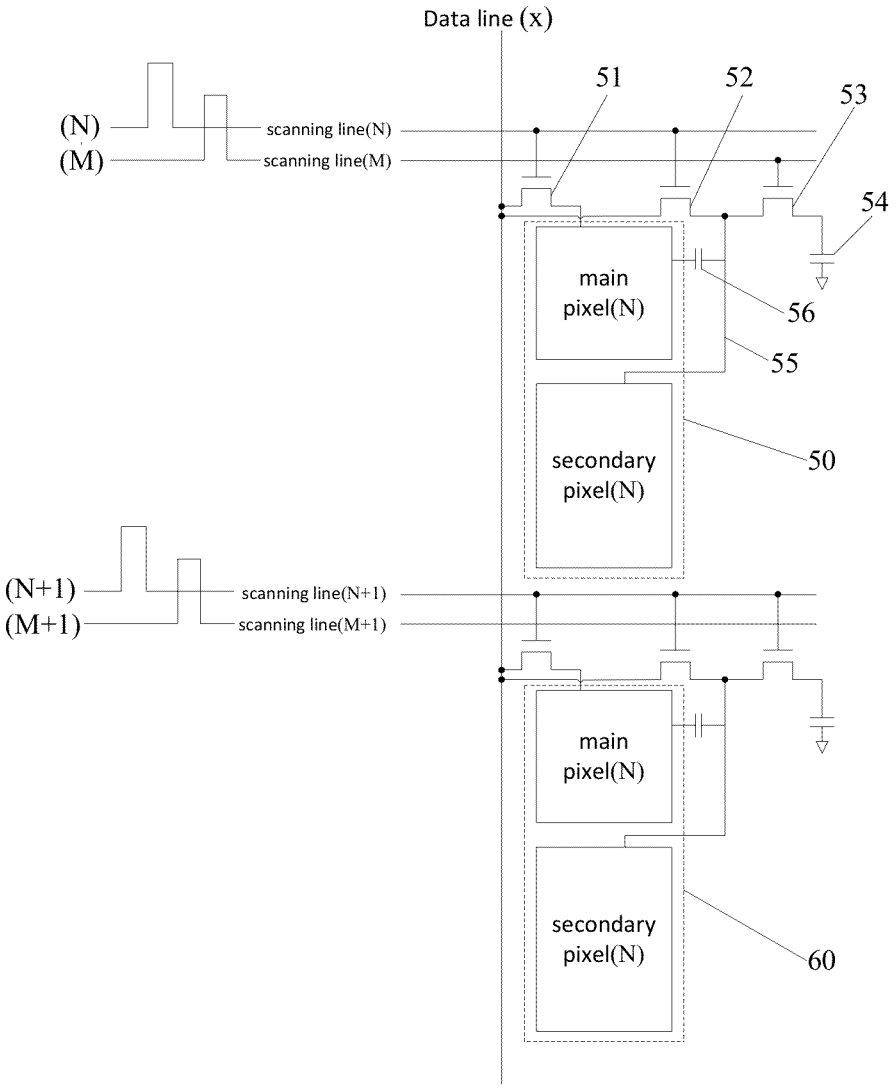
FIG. 4 is a schematic view of the pixels of another typical MVA liquid crystal display.
Figure 5:
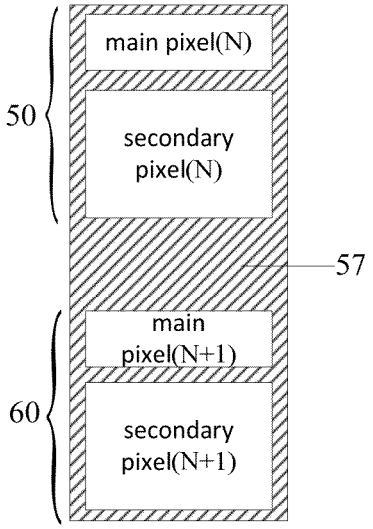
FIG. 5 is a planar view of the pixels of FIG. 4.
Figure 6:
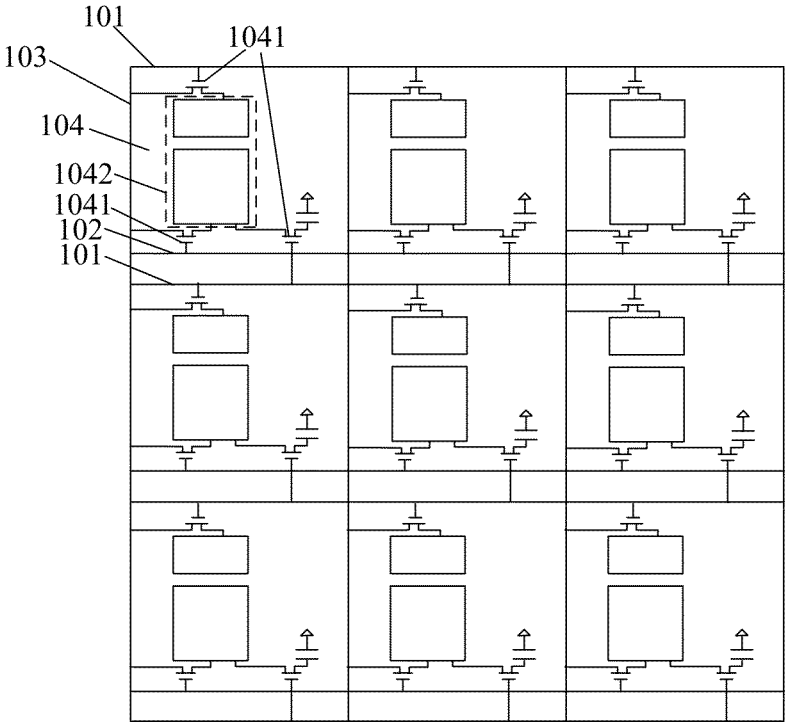
FIG. 6 is a schematic view of an array substrate of the MVA liquid crystal display in accordance with one embodiment

FIG. 6 is a schematic view of an array substrate of the MVA liquid crystal display in accordance with one embodiment. The array substrate includes a plurality of first scanning lines 101, a plurality of second scanning lines 102, a plurality of data lines 103, and a plurality of pixels 104 arranged in matrix. Each pixel 104 includes a switch 1041 and a pixel electrode 1042. Each pixel 104 corresponds to one first scanning line 101, one second scanning line 102, and one data line 103.

Figure 7:
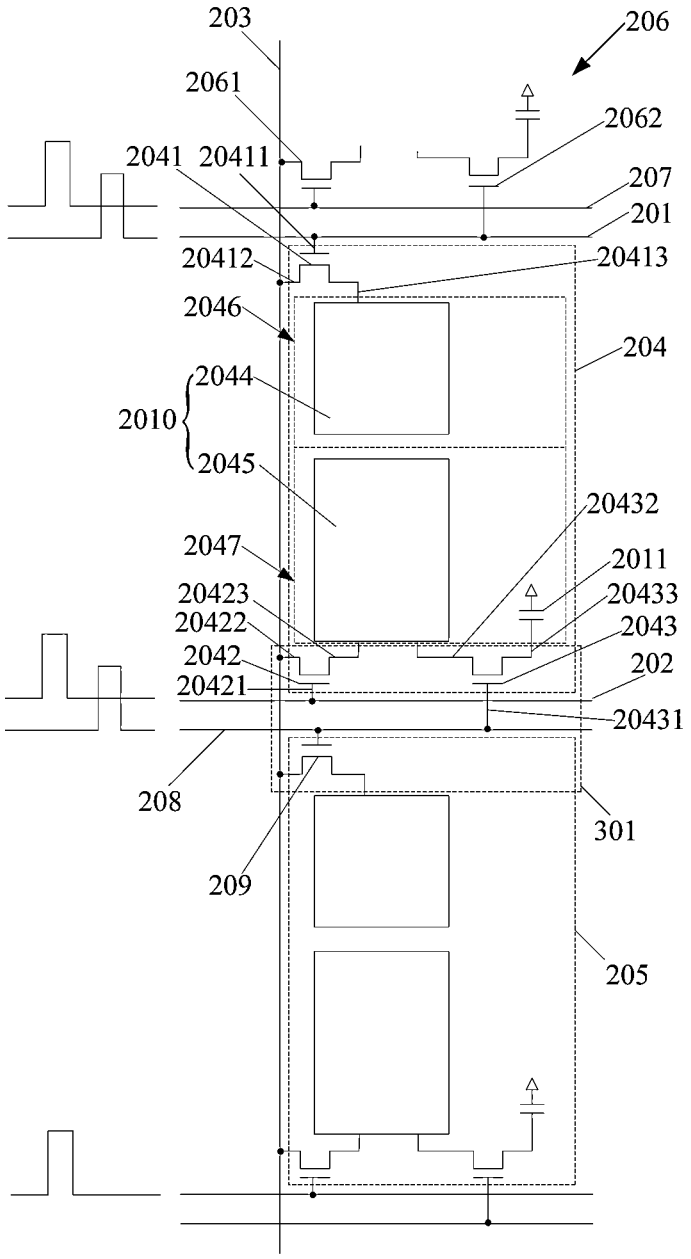
FIG. 7 is a schematic view of the pixels of the array substrate of FIG. 6.

FIG. 7 is a schematic view of the pixels of the array substrate of FIG. 6. The structures of a first pixel 204, a second pixel 205, and portions of a third pixel 206 are shown in FIG. 7. The three adjacent pixels are arranged along the data lines 203. The first pixel 204 includes a first switch 2041, a second switch 2042, and a third switch 2043. The pixel electrode 2010 of the first pixel 204 includes a main pixel electrode 2044 in a main pixel area 2046 and a secondary pixel electrode 2045 in a secondary pixel area 2047. The first scanning lines 201 inputs scanning signals to the first switch 2041 so as to turn on or off the first switch 2041. The second scanning lines 202 input scanning signals to the second switch 2042 so as to turn on or off the second switch 2042. The data lines 203 connect, to the main pixel electrode 2044 via a first output 20413 of the first switch 2041 to input data signals to the main pixel electrode 2044. A first connection line between the first output 20413 of the first switch 2041 and the main pixel electrode 2044 passes through the main pixel area 2046 to connect to the main pixel electrode 2044. The data line 203 connects to the secondary pixel electrode 2045 via a second output 20423 of the second switch 2042 to input data signals to the secondary pixel electrode 2045. A second connection line between the second output 20423 of the second switch 2042 and the secondary pixel electrode 2045 passes through the secondary pixel area 2047 to connect to the secondary pixel electrode 2044. It is to be noted that the second connection line does not pass through the main pixel area 2046.

By adopting the above arrangement, the first connection line does not pass through the secondary pixel area 2047, and the second connection line does not pass through the main pixel area 2046, and thus the parasitic capacitance between the main pixel area 2046 and the secondary pixel area 2047 are reduced.

Figure 8:
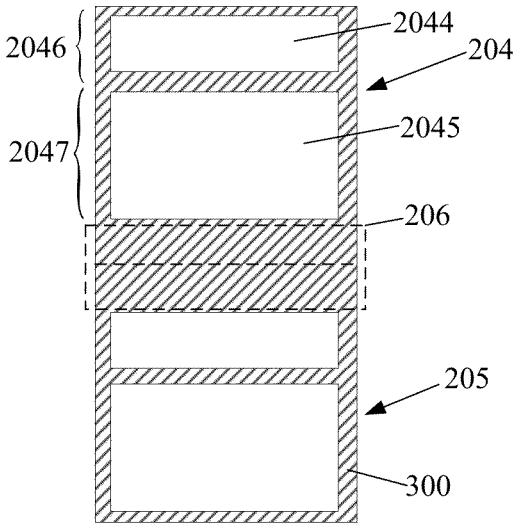
FIG. 8 is a planar view of the pixels of FIG. 7.

Referring to FIGS. 7 and 8, the array substrate further includes a dark area 300 (shaded portions in FIG. 8) corresponding to an opaque area. The first scanning lines 201, the second scanning lines 202, the first switch 2041, the second switch 2042, and the third switch 2043 are arranged between the first pixel 204 and the second pixel 205 and between the first pixel 204 and the third pixel 206. Specifically, portions of the dark area 300 are arranged between the pixels. For example, the dark area 301 is between the first pixel 204 and the second pixel 205. The first scanning lines 201 and the first switch 2041 are arranged on an tip side of the first pixel 204, and are adjacent to the second scanning lines 207, the second switch 2061 and the third switch 2062 so as to input the scanning signals to the main pixel electrode 2044. The second scanning lines 202, the second switch 2042 and the third switch 2043 are arranged on a down side of the first pixel 204, and are adjacent to the first scanning lines 208 and the first switch 209 of the second pixel 205 so as to input the scanning signals to the secondary pixel electrode 2045.

Furthermore, the array substrate is assembled to form a liquid crystal display. When the liquid crystal display is driven, a difference of the default voltage between the main pixel electrode 2044 and the secondary pixel electrode 2045 results in a color shift at a wide viewing angle. Specifically, with respect to the first switch 2041 of the first pixel 204, a first control end 20411 electrically connects with the first scanning lines 201. A first input 20412 electrically connects with the data lines 203. A first output 20413 electrically connects with the main pixel electrode 2044. With respect to the second switch 2042 of the first pixel 204, a second control end 20421 electrically connects with the second scanning lines 202. A second input end 20422 electrically connects with the data lines 203. A second output end 20423 electrically connects with the secondary pixel electrode 2045.

With respect to the third switch 2043 of the first pixel 204, a third control end 20431 electrically connects with the first scanning lines 208 corresponding to the second pixel 205A third input end 20432 electrically connects with the secondary pixel electrode 2045. A third output end 20433 electrically connects with a storage capacitor 2011 formed by a metal layer on the same side of the array substrate and a common electrode of a color filter substrate. The third output end 20433 of the third switch 2043 electrically connects to the metal layer such that the storage capacitor 2011 connects with the secondary pixel electrode 2045 via the third switch 2043.

Under a 3D display mode, the corresponding first scanning lines 201 and the second transmission circuit 202 of the first pixel 204 inputs the scanning signals to the first control end 20411 and the second control end 20421 so as to turn on the first switch 2041 and the second switch 2042. Afterward, the data lines 203 inputs the data signals to the first control end 20411 and the second control end 20421 such that the data signals are transmitted to the main pixel electrode 2044 and the secondary pixel electrode 2045 of the first pixel 204 via the first output 20413 and the second output 20423. After the data signals are input to the main pixel electrode 2044 and the secondary pixel electrode 2045, the level of the main pixel electrode 2044 and the secondary pixel electrode 2045 are the same. The first scanning line 201 and the second scanning line 02 are turn off to stop inputting the scanning signals to the first pixel 204. Afterward, the process to drive the second pixel 205 begins. The data signals are input to the corresponding first scanning lines 208 of the second pixel 205 so as to turn on the rust switch 209 of the second pixel 205. At this time, as the third control end 20431 of the corresponding third switch 2043 of the first pixel 204 electrically connects with the corresponding first scanning, lines 208 of the second pixel 205, the third switch 2043 is turn on when the first scanning lines 208 input the scanning signals.

When the liquid crystal display is driven, the display voltage changes between a positive voltage and a negative voltage to prevent the liquid crystal from being stationary in a direction. The display voltage is the positive voltage when the voltage of the pixel electrode 2010 is higher than the common electrode voltage. On the other hand, the display voltage is the negative voltage when the voltage of the pixel electrode 2010 is lower than the common electrode voltage. Before the corresponding third switch 2043 of the first pixel 204 is turn on, the polarity of the charges stored in the storage capacitor 2011 is opposite to that of the secondary pixel electrode 2045 of the first pixel 204. The capacitors of the secondary pixel electrode 2045 are neutralized with that of the storage capacitor 2011 via the third switch 2043, and the electrical field of the secondary pixel electrode 2045 becomes smaller. Thus, the voltage difference exists between the main pixel electrode 2044 and the secondary pixel electrode 2045. In conclusion, the adjustment of the storage capacitor 2011 result in the default voltage difference between the main pixel electrode 2044 and the secondary pixel electrode 2045. As such, the alignment of the liquid crystal is controlled so as to obtain a low color shift effect.

In one embodiment, the first switch 2041, the second switch 2042, and the third switch 2043 are respectively a first thin-film transistor, a second thin-film transistor, and a third thin-film transistor. Each thin-film transistors includes a gate operating as a control end, a source operating as an input end, and a drain operating as all output end. A first gate of the first thin-film transistor electrically connects with the first scanning lines 201 so as to turn on or off the first thin-film transistor. A first source electrically connects with the data lines 203 and a first drain electrically connects with the main pixel electrode 2044 so that the data lines 203 input the data signals to the main pixel electrode 2044 via the first thin-film transistor. A second gate of the second thin-film transistor electrically connects with the second scanning lines 202 so as to turn or off the second thin-film transistor. A second source electrically connects the data lines 203 and a second drain electrically connects with the secondary pixel electrode 2045 so that the data lines 203 input the data signals to the secondary pixel electrode 2045 via the second thin-film transistor. A third gate of the third thin-film transistor electrically connects with the corresponding first scanning lines 208 of the second pixel 205 so as to turn on or off the third thin-film transistor. A third source electrically connects with the secondary pixel electrode 2045 and a third drain electrically connects with the storage capacitor 2011 so as to control the default voltage difference between the main pixel electrode 2044 and the secondary pixel electrode 2045.

In one embodiment, the pixel electrode 2010 of the first pixel 204 includes the main pixel electrode 2044 and the secondary pixel electrode 2045. A first connection line between the first output 20413 of the first switch 2041 and the main pixel electrode 2044 passes through the main pixel area 2046 to connect to the main pixel electrode 2044. A second connection line between the second output 20423 of the second switch 2042 and the secondary pixel electrode 2045 passes through the secondary pixel area 2047 to connect to the secondary pixel electrode 2044. It is to be noted that the second connection line does not pass through the main pixel area 2046. In this way, the parasitic capacitance between the main pixel area 2046 and the secondary pixel area 2047 are reduced. The reliability of following mask processes, the transmission rate, and the aperture rate are enhanced. In addition, the dark area 301 is between the adjacent pixels along the data lines 203. The first scanning lines 201 and the first switch 2041 of the first pixel 204 are arranged between the first pixel 204 and the third pixel 206. The second scanning line 202, the second switch 2042 and the third switch 2043 are arranged between the first pixel 204 and the second pixel 205. The scanning lines and the switches are uniformly arranged between the pixels so as to increase the width of the dark area 301. As such, the crosstalk may be reduced at the wide viewing angle and the transmission rate may be enhanced. In addition, as the secondary pixel electrode 2045 connects with the storage capacitor 2011 via the third switch 2043, the default voltage difference between the main pixel electrode 2044 and the secondary pixel electrode 2045 may be controlled by adjusting the storage capacitor 2011. As such, the alignment of the liquid crystal is controlled so as to obtain a low color shift effect.

In one embodiment, the liquid crystal device includes a polarizing film and a liquid crystal panel. The polarizing film is tier separating a 3D image to left eye signals and right eye signals to be transmitted to viewers at the same time. The liquid crystal panel includes the array substrate and a color filter substrate. The color filter substrate includes a black matrix. The polarizing film is arranged on an outside of the color filter substrate.

Specifically, the array substrate includes a plurality of first scanning lines 101, a plurality of second scanning lines 102, a plurality of data lines 103, and a plurality of pixels 104 arranged in matrix. Each pixel 104 includes a switch 1041 and a pixel electrode 1042. Each pixel 104 corresponds to one first scanning line 101, one second scanning line 102, and one data line 103.

The structure of the first pixel 104 is shown in FIG. 7. It is to be noted that the dark area 301 between the first pixel 204 and the second pixel 205 is a vertically projected area of the black matrix of the color filter substrate. By arranging the first scanning lines 201, the second scanning lines 202, and the third switches 2041-2043 in the vertically projected area, the transmission rate and the aperture rate of the liquid crystal panel are increased.

In one embodiment, the liquid crystal panel is a MVA liquid crystal panel.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An array substrate of a multi-domain vertical alignment (MVA) liquid crystal display, comprising:

a plurality of first scanning lines, a plurality of second scanning lines, a plurality of data lines, and a plurality of pixels arranged in matrix, each pixel comprises switches and pixel electrodes, and each pixels corresponds to one first scanning line, one second scanning line and one data line;

the switches of each pixel comprises at least a first switch, a second switch and a third switch, and each of the switches comprises a control end an input end and an output end;

the pixel electrodes comprises a main pixel electrode and a secondary pixel electrode, the first scanning line and the second scanning line respectively connect with the first switch and the second switch so as to turn on or of the first switch and the second switch, the data lines pass through the respective areas where the main pixel electrode is located and where the secondary pixel electrode is located to connect to the main pixel electrode and the secondary pixel electrode such that voltage signals are input to the main pixel electrode and the secondary pixel electrode;

a dark area corresponding to an opaque area, at least portions of the dark area is arranged between the pixels, and the first scanning lines, the second scanning lines and the switches are arranged between the pixels;

wherein for any three adjacent pixels arranged along the data lines, the first scanning line and the first switch corresponding to the second pixel are adjacent to the second scanning line, the second switch and the third switch corresponding to the first pixel so as to input scanning signals to the main pixel electrode, the second scanning line, the second switch, and the third switch corresponding to the second pixel are adjacent to the first scanning line and the first switch corresponding to the third pixel so as to input the scanning signals to the secondary pixel electrode;

the output of the first switch electrically connects to the main pixel electrode, the output of the second switch electrically connects with the secondary pixel, the output of the third switch is for electrically connecting a storage capacitor, the inputs of the first switch and the second switch electrically connect to the data lines respectively, the input of the third switch electrically connects with the secondary pixel electrode, the control end of the first switch electrically connects the first scanning line, the control end of the second switch electrically connects the second scanning line, the control end of the third control switch electrically connects the second scanning line of the third pixel;

wherein the first scanning lines and the second scanning lines corresponding to the second pixel input the scanning signals in the 3D display mode to respectively turn on the first switch and the second switch, the data lines inputs the voltage signals to the main pixel electrode and the secondary pixel electrode of the second pixel respectively by the first switch and the second switch at the same time, and then the scanning signals are not input to the first scanning lines and the second scanning lines, the first scanning lines corresponding to the third pixel electrically connected to the control end of the third switch input the scanning signals to turn on the third switch, the voltage signals of the secondary pixel electrode of the second pixel couple with the storage capacitor electrically connected with the output of the third switch via the third switch to adjust the storage capacitor such that a difference between the default voltages of the main pixel electrode and the secondary pixel electrode of the second pixel is controlled.

2. The array substrate as claimed in claim 1, wherein the first scanning lines and the first switch of the pixel are arranged on the same side with the pixel, and the second scanning line, the second switch and the third switch are arranged on the other side of the pixel.

3. The array substrate as claimed in claim 1, wherein the storage capacitor is formed by a metal layer on the same side of the array substrate and a common electrode of the liquid crystal panel, and the polarity of the charges stored in the storage capacitor is opposite to that of the secondary pixel electrode.

4. The array substrate as claimed in claim 1, wherein the first switch, the second switch, and the third switch are respectively a first thin-film transistor, a second thin-film transistor, and a third thin-film transistor;

the first thin film transistor comprises a first gate, a first source and a first drain, the first source operates as an input electrically connected with the data lines, the first drain operates as an output electrically connected with the main pixel electrode, and the first gate operates as a control end electrically connected with the first scanning line to turn on or off the first thin film transistor;

the second thin film transistor comprises a second gate, a second source and a second drain, the second source operates as the input electrically connected with the data lines the second drain operates as the output electrically connected with the secondary pixel electrode, and the second gate operates as the control end electrically connected with the second scanning line to turn on or off the second thin film transistor; and the third thin film transistor comprises a third gate, a third source and a third drain, the third source electrically connects with the secondary pixel electrode, the third drain operates as the output for electrically connecting with the storage capacitor, and the third gate electrically connects with the first scanning lines corresponding to one adjacent pixel to turn on or off third thin film transistor.

5. A liquid crystal display, comprising:

a polarizing film and a liquid crystal panel comprising an array substrate and a color filter substrate;

the color filter substrate comprises a black matrix, and the polarizing film is arranged on an outside of the color filter substrate;

the array substrate comprising:

a plurality of first scanning lines, a plurality of second scanning lines, a plurality of data lines, and a plurality of pixels arranged in matrix, each pixel comprises switches and pixel electrodes, and each pixels corresponds to one first scanning line, one second scanning line, and one data line;

the switches of each pixel comprises at least a first switch, a second switch and a third switch, and each of the switches comprises a control end, an input end and an output end;

the pixel electrodes comprises a main pixel electrode and a secondary pixel electrode, the first scanning line and the second scanning line respectively connect with the first switch and the second switch so as to turn on or off the first switch and the second switch, the data lines pass through the respective areas where the main pixel electrode is located and where the secondary pixel electrode is located to connect to the main pixel electrode and the secondary pixel electrode such that voltage signals are input to the main pixel electrode and the secondary pixel electrode;

a dark area corresponding to an opaque area, the dark area is in a vertically projected area of the black matrix, at least portions of the dark area is arranged between the pixels, and the first scanning lines, the second scanning lines and the switches are arranged between the pixels;

wherein for any three adjacent pixels arranged along the data lines, the first scanning line and the first switch corresponding to the second pixel are adjacent to the second scanning line, the second switch and the third switch corresponding to the first pixel so as to input scanning signals to the main pixel electrode, the second scanning line, the second switch, and the third switch corresponding to the second pixel are adjacent to the first scanning line and the first switch corresponding to the third pixel so as to input the scanning signals to the secondary pixel electrode;

the output of the first switch electrically connects to the main pixel electrode, the output of the second switch electrically connects with the secondary pixel, the output of the third switch is for electrically connecting a storage capacitor, the inputs of the first switch and the second switch electrically connect to the data lines respectively, the input of the third switch electrically connects with the secondary pixel electrode, the control end of the first switch electrically connects the first scanning line, the control end of the second switch electrically connects the second scanning line, the control end of the third control switch electrically connects the second scanning line of the third pixel;

wherein the first scanning lines and the second scanning fines corresponding to the second pixel input the scanning signals in the 3D display mode to respectively turn on the first switch and the second switch, the data lines inputs the voltage signals to the main pixel electrode and the secondary pixel electrode of the second pixel respectively by the first switch and the second switch at the same time, and then the scanning signals are not input to the first scanning lines and the second scanning lines, the first scanning lines corresponding to the third pixel electrically connected to the control end of the third switch input the scanning signals to turn on the third switch, the voltage signals of the secondary pixel electrode of the second pixel couple with the storage capacitor electrically connected with the output of the third switch via the third switch to adjust the storage capacitor such that a difference between the default voltages of the main pixel electrode and the secondary pixel electrode of the second pixel is controlled.

6. The liquid crystal display as claimed in claim 5, wherein the first scanning lines and the first switch of the pixel are arranged on the same side with the pixel, and the second scanning line, the second switch and the third switch are arranged on the other side of the pixel.

7. The liquid crystal display as claimed in claim 5, wherein the storage capacitor is formed by a metal layer on the same side of the array substrate and a common electrode of the liquid crystal panel, and the polarity of the charges stored in the storage capacitor is opposite to that of the secondary pixel electrode.

8. The liquid crystal display as claimed in claim 5, wherein the first switch, the second switch, and the third switch are respectively a first thin-film transistor, a second thin-film transistor, and a third thin-film transistor;

the first thin film transistor comprises a first gate, a first source and a first drain, the first source operates as an input electrically connected with the data lines, the first drain operates as an output electrically connected with the main pixel electrode, and the first gate operates as a control end electrically connected with the first scanning line to turn on or of the first thin film transistor;

the second thin film transistor comprises a second gate, a second source and a second drain, the second source operates as the input electrically connected with the data lines, the second drain operates as the output electrically connected with the secondary pixel electrode, and the second gate operates as the control end electrically connected with the second scanning line to turn on or oft the second thin film transistor; and the third thin film transistor comprises a third gate, a third source and a third drain, the third source electrically connects with the secondary pixel electrode, the third drain operates as the output for electrically connecting with the storage capacitor, and the third gate electrically connects with the first scanning lines corresponding to one adjacent pixel to turn on or off the third thin film transistor.

9. The liquid crystal display as claimed in claim 5, wherein the liquid crystal panel is a MVA display.

* * * * *